US005878110A

United States Patent [19]

Yamamoto et al.

[11] Patent Number: 5,878,110

[45] **Date of Patent: *Mar. 2, 1999**

[54] X-RAY GENERATION APPARATUS

[75] Inventors: Yoshiyuki Yamamoto; Keiichiro Tanabe; Naoji Fujimori; Nobuhiro Ota, all of Itami, Japan

[73] Assignee: Sumitomo Electric Industries, Ltd., Osaka, Japan

[ * ] Notice: The term of this patent shall not extend beyond the expiration date of Pat. No. 5,657,365.

[21] Appl. No.: 907,883

[22] Filed: Aug. 11, 1997

Related U.S. Application Data

[63] Continuation-in-part of Ser. No. 515,096, Aug. 14, 1995, Pat. No. 5,657,365.

[30] Foreign Application Priority Data

| | | | |
|---|---|---|---|
| Aug. 20, 1994 | [JP] | Japan | 218074 |
| May 22, 1995 | [JP] | Japan | 148081 |

[51] Int. Cl.[6] ..... H05G 1/00

[52] U.S. Cl. ..... 378/143; 378/121; 378/141

[58] Field of Search ..... 378/119, 121, 378/124, 125, 127–130, 141, 143, 144

[56] References Cited

U.S. PATENT DOCUMENTS

| | | | |
|---|---|---|---|
| 3,329,847 | 7/1967 | Friedman . | |
| 3,992,633 | 11/1976 | Braun . | |
| 5,148,462 | 9/1992 | Spitsyn . | |
| 5,657,365 | 8/1997 | Yamamoto et al. | 378/143 |

FOREIGN PATENT DOCUMENTS

| | | |
|---|---|---|
| 0432568A2 | 6/1991 | European Pat. Off. . |
| 2358512 | 6/1975 | Germany . |
| 57-038548 | 6/1982 | Japan . |
| 2-267844 | 11/1990 | Japan . |
| 2-309596 | 12/1990 | Japan . |
| 3-274001 | 12/1991 | Japan . |
| 5-343193 | 12/1993 | Japan . |
| 52-99355 | 2/1994 | Japan . |
| 6-036718 | 2/1994 | Japan . |

*Primary Examiner*—David P. Porta

*Attorney, Agent, or Firm*—Beveridge, DeGrandi, Weilacher & Young, LLP

[57] ABSTRACT

An X-ray generation apparatus has an anticathode which includes a high thermal conductive substrate and a target for generating X-rays by irradiation with electrons. The target penetrates the high heat conductive substrate. Improved cooling efficiency and durability of the anticathode is obtained as well as miniaturization and simplification of the X-ray generation apparatus is achieved.

23 Claims, 3 Drawing Sheets

X-RAY GENERATION APPARATUS

This application is a continuation-in-part application of application Ser. No. 08/515,096, filed Aug. 14, 1995, which is now U.S. Pat. No. 5,657,365 relied on and incorporated herein by reference.

BACKGROUND OF THE INVENTION

1. Field of the Invention

The present invention relates to an X-ray generation apparatus, specifically, one which makes it possible to generate high X-ray output by use of a smaller apparatus than the conventional size apparatus.

The ordinary method, which generates X-rays using irradiation of accelerated electrons to a target, adapted an X-ray generation apparatus. However, when electrons, which are accelerated by some tens of thousands voltage, collide with the target, only 1% of the accelerated electron energy changes to X-ray energy and the remaining 99% is consumed by Joule's heat. It is essential to investigate how to effectively radiate one hundred times the thermal energy incidental to X-ray generation from the target, in order to obtain a high output X-ray generation apparatus. The range of X-ray strength generated by an apparatus depends on the target material and cooling ability. The generated X-ray energy can be increased by increasing electron irradiation energy within a range of the target not melted by irradiation of accelerated electrons.

Therefore, metal materials which have high thermal conductivity and high melting temperatures are mainly used as the X-ray target, and the thermal energy is radiated by water cooling. Furthermore, in order to obtain high strength X-rays, a method by which the target is cooled while rotating has been developed. In this method, a portion of the target which is irradiated by electrons and emits X-rays, rotates one after another, the temperature of the target does not increase, and higher X-ray energy can be obtained compared with a fixed type target.

2. Description of the Prior Art

A diamond containing target, in which the diamond is embedded in a copper substrate by powder sintering, is used and the target is cooled and rotated in an X-ray generation apparatus shown in Tokkai-Sho 57 (1982)-38548. However, it has been pointed out that as the size of such X-ray apparatus increases, it is imperative to prevent vibration when rotating the target. Furthermore, there are problems with decreased efficiency of the electron beam when the electron beam irradiates both copper and diamond.

An X-ray generation apparatus, in which an electron beam irradiates in the direction of a heat resistant single crystal axis, emits X-rays in the direction of the single crystal axis and a cooling means of the single crystal is prepared, as shown in Tokkai-Hei 2 (1990)-309596. However, the target is cooled insufficiently because the electron irradiating portion of the target is cooled through the peripheral portion of the single crystal.

An anticathode for X-ray generation which is made from a 2-layer structure of high heat conductive inorganic material and thin metal film, is shown in Tokkai-Hei 5 (1993)-343193. Effective cooling is expected when the back portion of the high heat conductive inorganic material is cooled as shown in this prior art. However, when the target is adapted for an X-ray generation apparatus and is cooled at the peripheral portion (as shown in Tokkai-Hei 2-309596), the target does not have sufficient cooling ability because a considerable amount of thermal energy diffuses along the thin metal film for which heat conduction is rather high. The other problem is exfoliation of the thin metal film. A method of synthesizing diamond from the gaseous phase is disclosed in U.S. Pat. No. 4,767,608 issued Aug. 30, 1988, and in U.S. Pat. No. 4,434,188 issued Feb. 28, 1994.

Spitsyn, U.S. Pat. No. 5,148,462, discloses a diamond substrate having a linear-shaped target made from a groove filled with target material. The linear shape target lacks the advantages of the target in the present invention made from a hole filled with target material of high cooling efficiency. Specifically, when the direction of the electron beam coincides with the direction of the penetration of the target, as in the hole configuration of the claimed invention, the electron beam reaches the inner portion of the target and the absorption ratio of the electron beam increases. The increased absorption results in an increased X-ray output.

Further, Spitsyn's device has a surface coating on the electron impinging side of the device, while the metal film or electric conductive diamond layer of the present invention is located on the side of the substrate that is not impinged with electrons (i.e. the back surface). Spitsyn's invention does not contemplate adding a layer to the back surface as in the present invention. Although Spitsyn discloses a surface coating, this coating is on the electron impinging side, and it generates some X-rays in the surface coating. The metal film or the electric conducting diamond layer, in combination with the hole configuration in the present invention, prevents X-ray formation in this layer.

The use of cooling holders is known in the art. Cooling an anticathode using such known holder merely cools the peripheral portion of the anticathode. The holder, therefore, inefficiently cools the entire anticathode because the cooling means is not proximate the target, which is the source of heat generation when electrons collide with the target. The present invention includes a much more efficient way to cool the targets. Cooling passages formed inside the anticathode itself surround the target, not merely the peripheral portion of the anticathode. Thus, more efficient cooling of the anticathode is possible. In an apparatus such as Spitsyn, it would be difficult to employ such cooling passages or tubes inside the anticathode because the groove-type target of Spitsyn would interfere with a practical pathway to pass coolant. It would be economically impractical to increase the size of an expensive diamond substrate simply to accommodate the configuration of a groove-type structure such as the one in Spitsyn. Using a hole configuration as in the present invention, the diamond substrate can remain smaller, and thus less expensive, and at the same time contain an efficient internal cooling means.

SUMMARY OF THE INVENTION

Responding to the controversy, the inventors have significantly improved the cooling efficiency and durability of the anticathode, miniaturized and simplified the X-ray generation apparatus, and have finally completed this high output and high strength X-ray generation apparatus invention. More particularly, there is described an X-ray generation apparatus having an anticathode in which a target is arranged to penetrate a high heat conductive substrate. The target emits X-rays when irradiated by electrons.

Since thermal conductivity of the high heat conductive substrate of at least 10 W/cm·k is preferable, a diamond is favored because it has high thermal conductivity and stability at high temperature. A natural single crystal diamond, a single crystal diamond synthesized under high pressure, and a polycrystalline diamond synthesized by chemical vapor deposition can be used as a high heat conductive substrate. A desired shape and comparatively large diamond can be obtained by chemical vapor deposition. A cubic boron nitride crystal can be used as another suitable material.

A material having the desired wavelength of characteristic X-rays can be used as a target material, therefore, for example, Mo, W, Cu, Ag, Ni, Co, Cr, Fe, Ti, Rh or an alloy of the above elements can be used.

Furthermore, to uniformly radiate the thermal energy generated at the target, it is preferable that the high heat conductive material is a disk and the target is arranged at the center of the substrate to penetrate the substrate.

One object of this invention is to provide an X-ray generation apparatus having an anticathode for X-ray generation in which a target is arranged to penetrate a high heat conductive substrate.

Another object of this invention is to provide a high heat conductive substrate having at least one groove in the substrate to pass a coolant.

Another goal of this invention is to provide a composite of a high heat conductive material arranged on a supporting material and having a groove in the side of the high heat conductive material of the intermediate surface.

Additional objects of this invention are to provide (a) a high heat conductive material (and electrical anticonductive material) with a metal film on one side of the material or (b) to provide an electrical conductive material that is a high heat conductive material having resistance of not more than $10^3$ Ω·cm partially or wholly. "Partially" refers to the material having a surface of the electrical anticonductive diamond that is coated with the electrical conductive doped diamond. "Wholly" refers to the electrical conductive doped diamond that is the whole high heat conductive material.

Said high heat conductive material is a diamond, preferably a gaseous phase synthesized diamond.

The portion of B-doped diamond which electrical resistance is not more than $10^3$ Ω·cm is used.

DETAILED DESCRIPTION OF THE PREFERRED EMBODIMENTS

Figure 1:
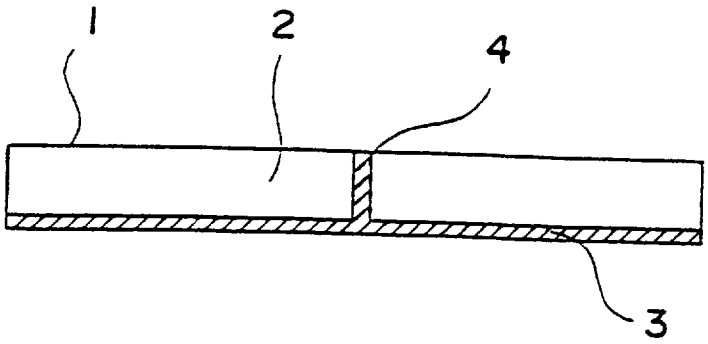
FIG. 1 shows a schematic cross-sectional view of an anticathode in accordance with this invention.

Using the construction of this invention, the X-ray output can be increased in any cooling system because the thermal energy generated at a target sufficiently radiates through the high heat conductive substrate. This construction demonstrates remarkable efficiency, especially in cooling the anticathode at the peripheral portion of the substrate. The high heat conductive material is arranged in the conduction direction of thermal energy in the present invention, cooling efficiency is remarkably improved compared with the conventional cathode plate, and consequently high X-ray output can be generated.

It is preferable that the substrate is as thick as possible from the viewpoint of cooling ability, however, excessive thickness is undesirable from the viewpoint of cost. The thickness of the substrate should range from 100 μm to 10 mm, and preferably from 300 μm to 5 mm. Furthermore, when a high heat conductive substrate which has a groove to pass a coolant, is adapted to an X-ray generation apparatus, the apparatus obtains high cooling efficiency simply with a cooling system to flow a coolant. As a result, the X-ray generation apparatus generates high output and high strength X-rays.

Furthermore, when a high heat conductive substrate which has a groove for conducting a coolant and which is adhered with an appropriate supporting material, is adapted to an anticathode of an X-ray generation apparatus, the apparatus obtains high cooling efficiency simply with a cooling system to flow a coolant. As a result, the X-ray generation apparatus generates high output and high strength X-rays. When a groove is prepared in a substrate or at a substrate side between the substrate and a supporting material, the cross section of the groove is preferably rectangular. The deeper (c) the groove, the higher the heat exchange efficiency of the anticathode. However, an excessive depth of the groove is undesirable because mechanical strength of the anticathode becomes weak. The depth of the groove (c) must not be smaller than 20 μm, and preferably not smaller than 50 μm. The depth of the groove should be smaller than 90% of the substrate thickness and preferably smaller than 80%. The width of the groove is broader and heat exchange efficiency of the anticathode passway is higher.

On the one hand, however, excessive width of the groove lowers heat exchange efficiency, because the number of pathways decreases to maintain mechanical strength of the substrate. On the other hand, excessive or insufficient width of the groove as well as the distance between the grooves (b) is undesirable. The width of the groove and the distance between the grooves should range from 20 μm to 10 mm, and preferably from 40 μm to 2 mm. The lower limit of the ratio (a/b) of the width (a) and the distance (b) is 0.02, and preferably 0.04. The upper limit of the ratio should be 50, and preferably 25. The lower limit of the ratio (a/c) of the width (a) and the depth (c) is preferably 0.05 and more preferably 0.1. The upper limit of the ratio is preferably 100 and more preferably 50.

The most suitable width, distance, and depth depend on the heat load and coolant pressure of the X-ray generation apparatus. The shape of the pathway can be not only rectangular but also semicircular, semielliptical and various complex shapes. Thus, the values for (a), (b) and (c) are not always uniform and are changeable within the above range in one anticathode. A ratio of (groove surface)/(substrate surface) of the front view of the substrate should range from 2–90% and more preferably in a range of 10–80%. An angle between the side surface of the groove and the line perpendicular to the substrate is preferably not larger than 30°.

A non-diamond carbon layer is useful at the surface of the groove in a thickness of 1 nm–1 μm. The non-diamond layer can be formed in a non-oxidation atmosphere (for example in a nonactive gas atmosphere) at a temperature of 1000°–1500° C. for 0.5–10 hours. Existence of the non-diamond layer is observed by the raman spectrum method. Excellent wetting of the surface to coolant is preferable. It is also preferable that the contact angle between the surface and the coolant is not larger than 65° and desirably not larger than 60°.

Since there are hydrogen atoms on the diamond surface, a diamond repels coolant such as water. Wetting of a diamond can be increased by changing the hydrogen atoms to hydrophilic group (for example OH) including an oxygen atom. To improve the wetting of a diamond, for example, a diamond is annealed in an oxidation atmosphere at temperatures of 500°–800° C. for 10 minutes–10 hours, or heated in a plasma of oxygen or gas which contains oxygen.

When oxygen plasma is used to make a groove, wetting of the groove is improved to some degree. The above means of improving wetting of the surface should be carried out after making a groove in the oxygen plasma.

Other treatments expose the surface to gas plasma which contains nitrogen, boron, and inert gas atoms. Water, air, inert gas such as nitrogen and argon, fluorocarbon, liquid nitrogen, liquid oxygen, and liquid helium can be used as a coolant.

Groove or tube methods are explained hereunder wherein a tube is formed in the interior of a substrate and a groove is formed on a substrate interface between the substrate and a supporting material. The tube method is explained first.

A tube is formed in a substrate by laser machining as a pathway for the coolant. A desired shaped plate made of a high heat conductive material is provided wherein a tube is made by collecting a laser beam at the side of the material. This tube forms a pathway through which the coolant flows, in the interior of the high heat conductive material.

Another method of making a tube is to adhere the first high heat conductive material having a groove to the second high heat conductive material. A high heat conductive material is worked into a desired shape. A groove is formed on one side of the first high heat conductive material by laser beam machining or selective etching. The laser beam machining removes material by collecting a laser beam at the surface of the material and a groove is made at the surface. An optional groove can be obtained by this method. A groove is made on the surface of the substrate by collecting a laser beam of sufficient energy density on the surface of the high heat conductive material, and gradually moving the collected portion. A YAG laser or Excimer laser can be used for this machining. Excimer lasers are preferable in view of optional depth, accuracy, and repeatability of machining.

The wavelength of the laser beam is preferred to range between 190–360 nm. Energy density of the laser beam should range between $10–10^{11}$ W/cm$^2$.

Energy density of one pulse should range between $10^{-1}$ J/cm$^2$–$10^6$ J/cm$^2$, when using a pulse laser. Furthermore, the divergence angle of the laser beam from the generator is in a range of $10^{-2}$–$5\times10^{-1}$ mrad and full width at half maximum of laser spectrum wavelength is in a range of $10^{-4}$ to 1 nm. Uniformity of energy distribution at the cross section of the laser beam should not be more than 10%. When pulse laser is collected by a cylindrical lens or a cylindrical mirror, good machining is obtained.

A groove is formed by the etching method described below. After adequate masking is formed on the surface of the high heat conductive material, the etching condition is selected so that only the material and not the masking is etched. When removing the masking, the first high heat conductive material having the groove on the surface is obtained. It is known that a diamond surface masked by Al or $SiO_2$ is selectively etched by oxygen or oxygen-containing gas; see Extended Abstract vol. 2 (The 53rd Autumn Meeting 1992); The Japan Society of Applied Physics. Using this technique, a groove is formed on the diamond. Nitrogen or hydrogen can be a substitute for oxygen or oxygen-containing gas.

The first high heat conductive material having desired grooves is adhered to the second high heat conductive material, and then a substrate of extremely high heat irradiation efficiency is obtained. An exit and entrance of coolant can be formed on the second high heat conductive material. The groove is formed only on the first high heat conductive material in the above example, however, it is possible that the surface of the second high heat conductive material having a groove is adhered to the surface of the first high heat conductive material having a groove. But the process becomes complicated, and it is preferable that the groove is formed only on the first high heat conductive material.

The adherence of the first high heat conductive material to the second high heat conductive material can be carried out by metalizing or adhering. It is possible for both of the two surfaces to be metalized by a prior technique, and then melting the metal to adhere. Metals such as Ti, Pt, Au, Sn, Pb, In and Ag are used for metalizing. For the adhesive (for example Ag/epoxi-group, Ag/polyamide-group and Au/epoxi-group), Ag-brazing material and other adhesives can be used. The thickness of the adhesive is in a range of 0.01–10 $\mu$m.

When CVD diamond is used as the first high heat conductive material, the groove is made not only by laser beam machining and etching but also by selective growth by masking.

The selective growth method is described in Tokkai-Hei 1-104761 and Tokkai-Hei 1-123423. A masking material is arranged corresponding to the desired groove on a base such as Si, SiC, Cu, Mo, CBN, on which diamond is synthesized.

In this case, when diamond is synthesized in more than 50 $\mu$m thickness, diamond is grown even on the mask portion and as a result, diamond entirely covers the base. The base is then removed by means such as a dissolution method, and the obtained diamond has a groove on the base side. Ti, $SiO_2$ and Mo are formed on the base as a mask by a known method. The advantage of this method is that breakage during machining rarely occurs because this method does not need shock or impact for machining.

Instead of forming a mask in the above method, it is possible for diamond to be synthesized on a base having a projection corresponding to the groove. After synthesizing diamond to the desired thickness, and then removing the base, free-standing diamond having a groove on the plate side is obtained. Si, SiC, and Mo can be used as a base. To improve the above method, adhering can be omitted. A mask is formed on a free-standing diamond, and diamond is synthesized on the free-standing diamond and then the mask is removed. A substrate having a tube can be obtained. Heat conductive efficiency of a substrate is further improved because an adhesive is not used. All of the above methods are preferable for precisely forming micro grooves. The laser method is preferable for machining speed. The masking method is preferable for large grooves. The second high heat conductive material can be selected from B, Be, Al, Cu, Si, Ag, Ti, Fe, Ni, Mo, and W, their alloys and their compounds such as carbide and nitride as a supporting material. Diamond can also be used as the supporting material.

Accompanied by improved cooling ability, high output X-rays can be obtained in minute width of line since the target is not damaged by the narrower-than-usual electron beam focus and increasing load to the target. The target which penetrates the substrate is grounded from a backside surface of the anticathode (opposite side of electron irradiation surface) and contributes to stabilizing X-ray generation. To ground the target from a backside surface, it is preferred for a thin metal film to be deposited on the back surface of the anticathode.

Furthermore, when gaseous phase synthesized diamond is used as a high heat conductive material, it is easy to ground a target using electric conductive diamond as a substrate. The electric conductive diamond is arranged as a layer in the substrate or a whole substrate. The electric conductive diamond is synthesized by adding impurities in raw material gas. Such impurities are B, Al, Li, P, S and Se. Boron is preferable, because the addition of boron in diamond increases electric conductivity efficiently without prohibiting crystallization. The electric resistivity of the diamond is not more than $10^3$ Ω·cm and preferably not more than $10^2$ Ω·cm.

The combination of the target that penetrates the high thermal conductivity diamond substrate and the metal film on the backside of the substrate (i.e. not the electron impinging side) or the use of an electric conductive diamond, prevents the target from charging up and prevents X-rays from being generated in the metal film or electric conductive diamond layer.

In addition, when the direction of electron beam coincides with the penetration direction of the target, an electron beam reaches the inner portion of the target and absorption ratio of the electron beam increases. The prior art such as Spitsyn, has a device of low cooling efficiency. Spitsyn's linear-shaped target (i.e. groove) or 2-layer structure generates a linear shaped X-ray. Spitsyn's linear target generates a lower X-ray output than the target configuration of the present invention which allows the direction of the electron beam to coincide with the penetration direction of the target. For this reason, this invention is more useful to increase X-ray output than a target such as Spitsyn's or others which have 2-layer structures of high heat conductive inorganic material and thin metal film.

As explained above, the output and stability of X-rays can be increased using the presently invented X-ray generation apparatus. Also, the apparatus can make the width of the X-ray beam narrower, and produce more output compared to the conventional apparatus. Furthermore, since the above advantages are obtained without using a rotating anticathode target, the whole apparatus becomes a small and simple construction.

Therefore, the apparatus can be made inexpensively. Furthermore, vibration accompanied by rotation is prevented.

These advantages make the invented apparatus possible to use in X-ray analyzed apparatus, X-ray deposition apparatus and such various X-ray apparatus.

The invention is now explained in the following examples:

EXAMPLE 1

A polycrystalline diamond substrate (heat conductivity 16.9 W/cm·k) of 10 mm diameter and 1 mm thickness was prepared by chemical vapor deposition method. A pore of 0.2 mm diameter penetrated at the center of the substrate (2) by laser beam. A target of copper was arranged in the pore and then copper was evaporated on the back surface of the substrate and an anticathode (1) as shown in FIG. 1 was prepared. FIG. 1 shows that thin film of copper (3) was uniformly deposited on the back surface of the diamond substrate, the filled portion (4) was constructed by filling up the penetrated pore with copper.

Figure 2:
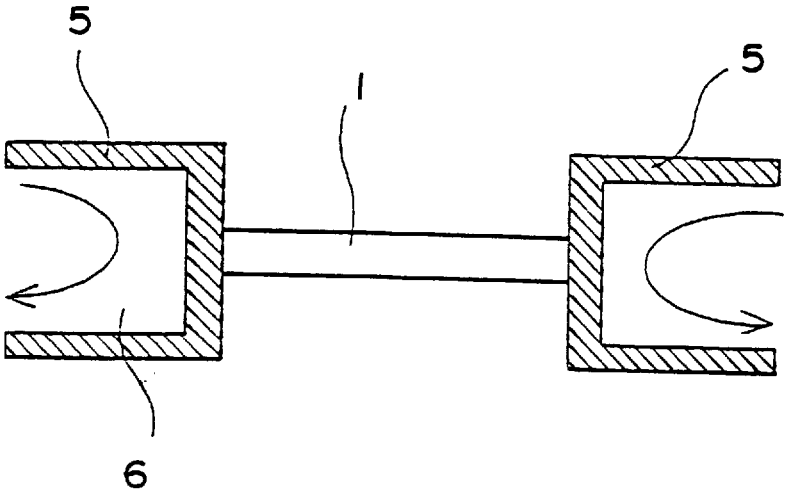
FIG. 2 shows a schematic view of an anticathode arranged on a holder.

Then, the anticathode was set at the cooling holder (5) as shown in FIG. 2. This holder (5) is ring shaped, the anticathode (1) was fixed at the central hole portion and cooling water (6) circulated in the outer peripheral portion. FIG. 2 was arranged to cool the cathode plate from the outer peripheral portion. It is considered that a specific means for setting the anticathode (1) is brazing, pinching, and melting filled powder. The copper film (3) at the back surface of the substrate was grounded to prevent charging up of copper metal target.

Electron beam of 0.15 mm diameter continuously irradiated exposed metal copper at the filled portion (4) from the surface of the substrate by a load of 10 kw/$mm^2$. It was confirmed that the apparatus stably emitted X-rays after 1000 hours irradiation. The copper metal was examined after the test; there is no remarkable change in the surface condition.

The copper film was deposited on the back surface of the diamond target in this example, this copper film was not intrinsic.

EXAMPLE 2

Figure 3:
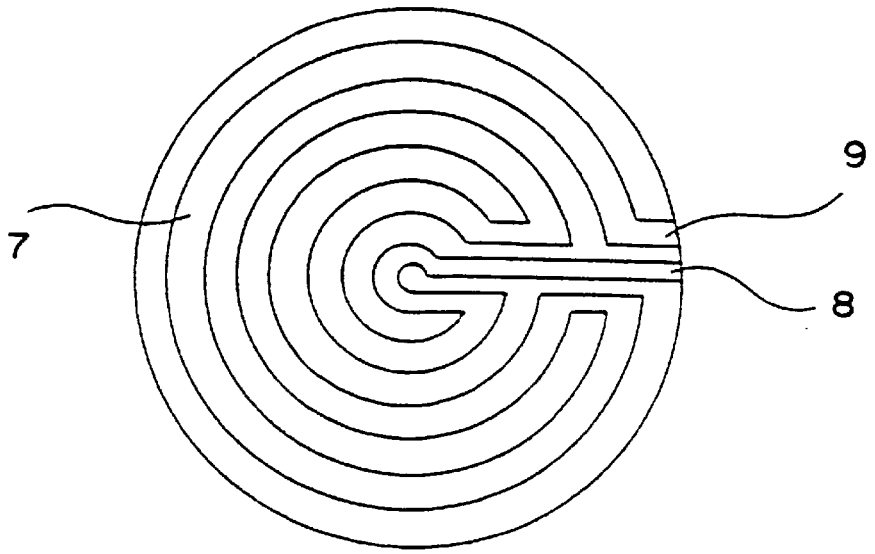
FIG. 3 shows the pattern of the groove to conduct a coolant.

Two scratched polycrystalline Si bases were prepared with a size of 10 mm diameter and 2 mm thickness. A diamond was synthesized on the Si base by micro-wave plasma-CVD method. Then the surface of the diamond was mechanically polished, and the Si base was dissolved by acid. The first diamond plate was of 10 mm diameter and 600 μm thickness. Heat conductivity was 17.9 W/cm·k. The second diamond plate was of 10 mm diameter and 400 μm thickness. Heat conductivity was 15.2 W/cm·k. These two diamond plates were free-standing. Grooves were formed on the surface of the first diamond plate as shown in FIG. 3 by KrF Excimer laser of lineal focus and point focus. A depth of the groove is about 100 μm, width of the groove is about 500 μm and the distance between the grooves is about 400 μm. Both of the diamond plates were coated in the order of Ti, Pt and Au by evaporation. Both of the coated surfaces were put together and then Au was melted to adhere the two diamond plates. The substrate was 10 mm diameter and 1 mm thickness and had a tube to pass a coolant.

Figure 4:
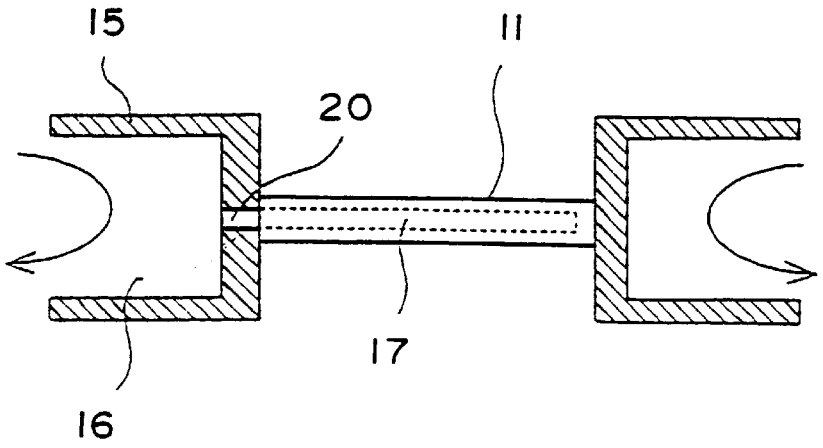
FIG. 4 shows a schematic view of an anticathode arranged in a holder, wherein the anticathode is composed of two adhered diamond plates and has a groove in it.
Figure 5:
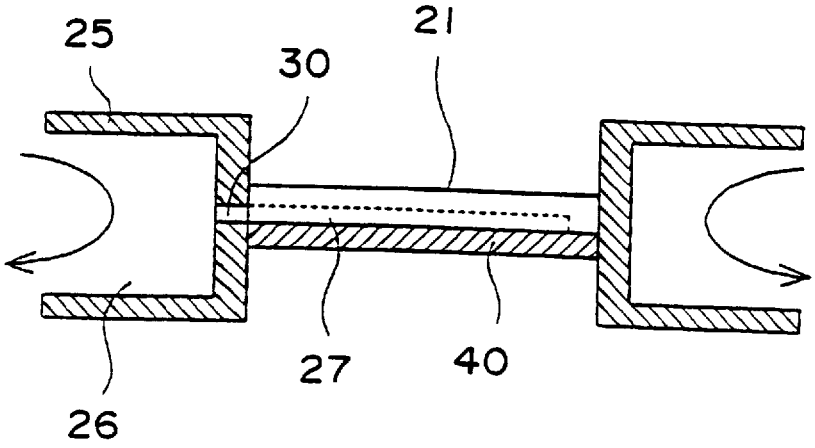
FIG. 5 shows a schematic view of an anticathode arranged in a holder, wherein the anticathode is composed of a diamond plate adhered to a supporting material and has a groove at the intermediate surface.

A penetrating hole was formed in the substrate, and then filled with copper as explained in Example 1. Then a substrate was prepared by coating Cu on one side. Then the substrate was set in a cooling holder (15) as shown in FIG. 4. This holder (15) was designed so that water, which cooled the substrate, was supplied from the side of the substrate. Cu coated surface was grounded to prevent the charging up of the copper target.

An X-ray generation apparatus which used the substrate, was tested under the same conditions as described in Example 1. Stability and durability are as excellent as Example 1.

EXAMPLE 3

A scratched polycrystalline Si base was prepared at a size of 10 mm diameter and 2 mm thickness. A diamond was synthesized on the Si base by micro-wave plasma CVD method. Then the surface of the diamond was mechanically polished, and the Si base was dissolved by acid. The diamond plate was 10 mm diameter and 1 mm thickness. Heat conductivity of the free-standing diamond plate was 17.3 W/cm·k. Grooves were formed on one side of the free-standing plate, as shown in FIG. 3, by KrF Excimer laser of lineal focus and point focus. A depth of groove is about 300 $\mu$m, width of the groove is about 500 $\mu$m and the distance between the grooves is about 400 $\mu$m.

Figure 6:
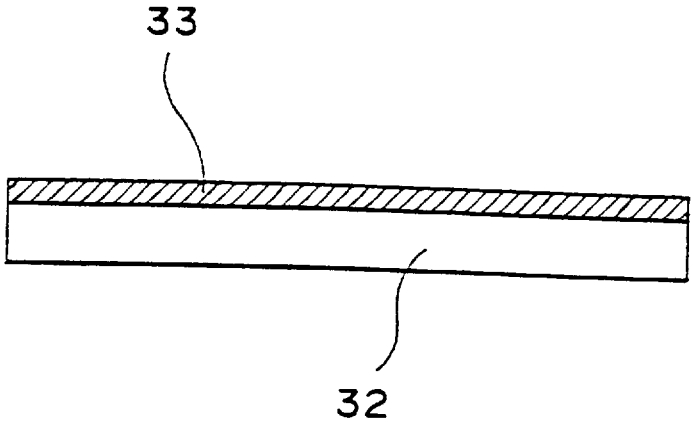
FIG. 6 shows a schematic cross-sectional view of a prior art anticathode.

A penetrating hole was formed in the free-standing substrate by laser beam, and then filled with copper as in Example 1. A Cu—W alloy plate was prepared at a size of 10 mm diameter for a supporting material. The surface of the diamond substrate having grooves was coated in the order of Ti, Pt and Au. One side of the Cu—W alloy plate was also coated in the order of Ti, Pt and Au. Both of the coated sides were adhered together by melting Au, and a substrate was obtained. Then the substrate was set in the cooling holder as shown in FIG. 6. This holder was designed so that water which cooled the substrate, was supplied from the side of the substrate.

An X-ray generation apparatus which used the substrate, was tested under the same conditions as described in Example 1. Stability and durability were as excellent as in Example 1.

EXAMPLE 4

A scratched polycrystalline Si base was prepared at a size of 10 mm diameter and 2 mm thickness. A diamond was synthesized on the Si base by micro-wave plasma CVD method. Then the surface of the diamond was mechanically polished, and the Si base was dissolved by acid. The diamond plate was 10 mm diameter and 1 mm thickness. Heat conductivity of the free-standing diamond plate was 17.3 W/cm·k. Because raw material gases contained B at the time when synthesizing the diamond, electric resistance was 1.95 Ω·cm.

A penetrating hole was formed in the free-standing diamond by laser beam, and then filled with copper as in Example 1. Then the substrate was set in the cooling holder. An X-ray generation apparatus which used the substrate, was tested under the same conditions as described in Example 1. Stability and durability were as excellent as Example 1.

Comparative Example 1

A copper disk of 10 mm diameter and 1 mm thickness was set in the holder (5) as shown in FIG. 2.

The disk was continuously irradiated by an electron beam of 0.15 mm diameter and it was found that the X-rays did not generate in a stable way under a load of 4 kw/mm$^2$, and that the irradiated portion of the disk was considerably damaged by heat energy after 100 hours.

Comparative Example 2

A polycrystalline diamond disk substrate (7) of 10 mm diameter and 1 mm thickness was prepared and copper was evaporated on one side of the disk as shown in FIG. 6. Then, the disk was set in the holder (5) as shown in FIG. 2.

Results of X-ray generation tests, which were carried out as Example 1 and comparative Example 1, showed that stable X-rays were obtained after 100 hours testing under a load of 4 kw/mm$^2$, and remarkable change was not recognized at the surface of the metal copper film. Under a load of 10 kw/mm$^2$, however, damage was observed and output of X-ray gradually decreased, at the irradiated portion of the metal copper film (8) after 500 hours irradiation.

Further variations and modifications of the foregoing will be apparent to those skilled in the art and are intended to be encompassed by the claims appended hereto.

Japanese priority applications 218074/1994 and 148081/1995 and U.S. patent application Ser. No. 08/515,096 are relied on and incorporated herein by reference.

We claim:

1. An X-ray generation apparatus having an anticathode comprising:

a high thermal conductivity diamond substrate;

said diamond substrate having a hole penetrating said diamond substrate filled with target material;

said target material forming a target for generating X-rays by irradiation of electrons;

said target penetrating said diamond substrate; and said diamond substrate is synthesized using a gaseous phase method.

2. The X-ray generation apparatus according to claim 1, wherein said diamond substrate has at least one pathway surrounding said target to pass a coolant in said diamond substrate.

3. The X-ray generation apparatus according to claim 1, wherein said target is made from a metal selected from a group consisting of Mo, W, Cu, Ag, Ni, Co, Cr, Fe, Ti, and Rh or an alloy thereof.

4. The X-ray generation apparatus according to claim 1, further comprising:

a metal film or an electric conductive diamond layer formed on a back surface of said anticathode.

5. The X-ray generation apparatus according to claim 1, wherein the electrical resistance of said diamond substrate is not more than $10^3$ Ω·cm.

6. The X-ray generation apparatus according to claim 1, wherein said diamond substrate is a disk and the target is located at the center of said substrate.

7. The X-ray generation apparatus according to claim 2, wherein said high thermal conductivity diamond substrate is arranged in a holder.

8. The X-ray generation apparatus according to claim 1, wherein said hole is circular.

9. The X-ray generation apparatus according to claim 1, wherein said target penetrates said diamond in a direction that coincides with the direction of an electron beam.

10. The X-ray generation apparatus according to claim 2, further comprising a supporting material for mounting said diamond substrate; and said diamond substrate having a groove defined therein adjacent said supporting material forming said at least one pathway therebetween;

wherein said groove has a width (a), a distance between two portions of said groove (b), and a depth of said groove (c), wherein a ratio of a/b is from 0.02 to 50, and wherein a ratio of a/c is from 0.05 to 100, and said distance b is 20 $\mu$m to 10 mm.

11. The X-ray generation apparatus according to claim 10, wherein said ratio of a/b is from 0.04 to 25, and wherein said ratio of a/c is from 0.1 to 50, and said distance b is 40 $\mu$m to 2 mm.

12. The X-ray generation apparatus according to claim 10, wherein a cross section of said groove is rectangular, semicircular or semielliptical.

13. The X-ray generation apparatus according to claim 10, wherein a ratio of a surface of said groove to a front surface of said substrate is from 2–90%.

14. The X-ray generation apparatus according to claim 10, wherein a ratio of a surface of said groove to a front surface of said substrate is from 10–80%.

15. The X-ray generation apparatus according to claim 10 further comprising a non-diamond carbon layer on said diamond substrate located on the surface of said groove having a thickness of 1 nm to 1 $\mu$m.

16. A method of making an anticathode as defined in claim 1 having an interior tube comprising shaping said high thermal conductivity diamond substrate into a desired shape, collecting a laser beam at a side of said high thermal conductivity diamond substrate, forming a tube in the interior of said high thermal conductivity diamond substrate with said collected laser beam to form a pathway for flowing coolant.

17. A method of making the anticathode as defined in claim 1 having an interior tube comprising etching a groove in said high thermal conductivity diamond substrate, adhering said high thermal conductivity diamond substrate as a first high heat conductive material to a second high heat conductive material to form an adhered high thermal conductivity diamond substrate and second high heat conductive material, wherein said high thermal conductivity diamond and said second high heat conductive material define an interior tube there between, shaping said adhered high thermal conductivity diamond substrate and said second high heat conductive materials.

18. The method of making the anticathode having the interior tube according to claim 17 further comprising forming an exit and an entrance on said high heat conductive material.

19. The method of making the anticathode having the interior tube according to claim 17 further comprising etching a groove in said second high heat conductive material before said adhering step.

20. The method of making the anticathode having the interior tube as defined in claim 17 wherein said second high heat conducting material is a member selected from the group consisting of B, Be, Al, Cu, Si, Ag, Ti, Fe, Ni, Mo, W, and alloys of said elements.

21. A method of making the anticathode as defined in claim 1 having a groove comprising masking a substrate with a mask corresponding to a desired groove to form a masked substrate;

synthesizing said high thermal conductivity diamond substrate on said masked substrate;

removing said masked substrate to form said high thermal conductivity diamond substrate having a groove.

22. The method of making the anticathode as defined in claim 1 having an interior tube comprising synthesizing a first layer of said diamond substrate on a base having a projection corresponding to a groove to form said diamond substrate having a groove on said base;

subsequently removing said base;

masking said diamond substrate having a groove to form a mask on said diamond substrate to obtain a masked diamond substrate;

synthesizing a second layer of a diamond on said masked diamond substrate having a groove;

removing said mask; and thereby forming a tube in between said first layer of said diamond substrate and said second layer of said diamond.

23. A method for X-ray generation comprising irradiating said anticathode having a target as defined in claim 1 with electrons;

cooling said target;

emitting X-rays from said target.

* * * * *